US009765775B2

(12) United States Patent
Geue et al.

(10) Patent No.: US 9,765,775 B2
(45) Date of Patent: Sep. 19, 2017

(54) VANE PUMP

(71) Applicant: Hella KGaA Hueck & Co., Lippstadt (DE)

(72) Inventors: Ingo Geue, Bad Sassendorf (DE); Theodor Hüser, Geseke (DE); Dennis Marburg, Lippstadt (DE); Udo Schubert, Paderborn (DE); Thomas Valeiras, Lippstadt (DE)

(73) Assignee: Hella KGaA Hueck & Co., Lippstadt (DE)

( * ) Notice: Subject to any disclaimer, the term of this patent is extended or adjusted under 35 U.S.C. 154(b) by 457 days.

(21) Appl. No.: 14/479,788

(22) Filed: Sep. 8, 2014

(65) Prior Publication Data

US 2015/0078946 A1 Mar. 19, 2015

(30) Foreign Application Priority Data

Sep. 19, 2013 (DE) ..... 10 2013 110 351

(51) Int. Cl.
*F04C 2/344* (2006.01)
*F04C 14/22* (2006.01)
*F04C 18/344* (2006.01)

(52) U.S. Cl.
CPC ..... *F04C 2/3442* (2013.01); *F04C 14/226* (2013.01); *F04C 18/3446* (2013.01); (Continued)

(58) Field of Classification Search
CPC .. F04C 2/3442; F04C 18/3446; F04C 14/226; F04C 2250/301; F04C 2220/10; F04C 2250/00
See application file for complete search history.

(56) References Cited

U.S. PATENT DOCUMENTS 2,347,944 A * 5/1944 Fowler ..... F01C 21/106 418/150
2,791,185 A 5/1957 Bohnhoff et al.
(Continued)

FOREIGN PATENT DOCUMENTS

DE 3800324 C2 10/1992
JP 57010787 A 1/1982

*Primary Examiner* — Wesley Harris
(74) *Attorney, Agent, or Firm* — Husch Blackwell LLP

(57) ABSTRACT

A vane pump with a pump housing in which a cam ring is constructed or arranged, and wherein a rotor is provided that is mounted in the cam ring so that it can rotate about a rotational axis , wherein the cam ring has an inner contour with a variable radius that varies between a maximum radius and a minimum radius in the circumferential direction about the rotational axis , wherein, in the radial gap between the inner contour and the rotor , a number of lift sections is constructed with pump chambers constructed in these sections, and wherein vane elements are mounted on the rotor , wherein these elements slide against the inner contour of the cam ring and limit the pump chambers in the circumferential direction. According to the invention, the radius of the inner contour varies about the rotational axis according to the function: $r=r_0+a\cdot\sin(n\cdot\phi)$, where $r_0=(r_{max}+r_{min})/2$, $a=(r_{max}-r_{min})/2$, and $\phi$=phase angle of the radius (r) between ($r_{min}$) and ($r_{max}$) in the direction of rotation of the rotor .

7 Claims, 2 Drawing Sheets

(52) U.S. Cl.
CPC ..... *F04C 2220/10* (2013.01); *F04C 2250/00* (2013.01); *F04C 2250/301* (2013.01)

(56) References Cited

U.S. PATENT DOCUMENTS 2,985,110 A * 5/1961 Burt ..... F01C 1/3446
418/150
3,261,227 A * 7/1966 Lomnicki ..... F01B 1/0648
74/567
3,642,390 A * 2/1972 Ostberg ..... F01C 21/106
418/133
4,480,973 A * 11/1984 Ishizuka ..... F01C 21/106
418/150
4,712,987 A * 12/1987 Inomata ..... F04C 18/3446
418/150

* cited by examiner

VANE PUMP

CROSS REFERENCE

This application claims priority to German Application No. 10 2013 110351.0, filed Sep. 19, 2013, which is hereby incorporated by reference.

FIELD OF THE TECHNOLOGY

The present invention relates to a vane pump with a pump housing in which a cam ring is constructed or arranged and wherein a rotor is provided that is mounted in the cam ring so that it can rotate about a rotational axis, wherein the cam ring has an inner contour with a variable radius that varies between a maximum radius and a minimum radius in the circumferential direction about the rotational axis, wherein, in the radial gap between the inner contour and the rotor, a number of lift sections is constructed with pump chambers constructed in these sections, which form the so-called vane cells and wherein, on the rotor, vane elements are mounted, wherein these elements slide against the inner contour of the cam ring and limit the pump chambers in the circumferential direction.

BACKGROUND

From DE 10 2004 002 076 A1, a vane pump with a pump housing is known and a cam ring is mounted in the pump housing. In the cam ring, a rotor is arranged so that it can rotate about a rotational axis and the cam ring has an inner contour, with vane elements mounted on the rotor sliding against this inner contour when the rotor rotates about the rotational axis. In this way, lift sections with several pump chambers are formed for each lift section, with these chambers being limited by the vane elements in the circumferential direction.

The cam ring is mounted so that it can move in the pump housing and so that the cam ring can be moved out from a concentric arrangement with the rotor, wherein a lift section with a variable volume can be created and if the rotor is set in rotation with the vane elements, then the volume of each lift section that is divided in the circumferential direction by the vane elements for forming individual pump chambers increases and decreases. By increasing and decreasing the volumes of the pump chambers, a fluid can be suctioned from a suction opening that can be connected to a suction connection and the fluid can be fed to a pressure opening after compression through corresponding reduction of the pump chambers by means of a rotational angle of the rotor, so that the fluid can escape again compressed through the pressure opening from the pump chambers. Despite the displacement of the cam ring from the rotational axis, the inner contour of the cam ring here corresponds to a circle.

GB 848,760 A shows a vane pump with several lift sections that extend between an inner contour of a cam ring and a rotor. The inner contour of the cam ring has several indentations that include a contour like a cylindrical section. Distributed over the circumference, six lift sections are created in this way that are covered by the ends of the spring-loaded vane elements.

DE 43 03 115 A1 shows another embodiment of a vane pump with a cam ring in which a rotor is mounted so that it can rotate about a rotational axis and the inner contour of the cam ring has an elliptical shape. The outer ends of the vane elements slide on the inner contour. These ends are mounted on and rotate with the rotor and it is clear that, through the construction of the elliptical shape for forming the outer limits of the lift sections, larger pump chamber volumes can be created than with lift sections that are formed with an inner contour of a cam ring and have a cylindrical shape.

An elliptical contour disadvantageously leads to greater wear of the vane pump, which must be accounted for by using larger volumes for the pump chambers. If cylindrical inner contours of the cam ring are used to form the lift sections, for slightly less wear, only comparatively small volumes of the pump chambers are created, so that it is desirable to increase the volumes of the pump chambers without here increasing the wear of the vane pump.

The greater the radial height of the lift sections above the outer contour of the rotor is, the greater the vane elements accelerate outward and inward again in their lifting motion due to the sliding against the more strongly formed inner contour, as is created, for example, with an elliptical shape. In addition to increased wear, this acceleration behavior also leads to increased noise development, so that it is further desirable to optimize the acceleration profile of the vane cells when sliding against the inner contour for a minimal noise development.

SUMMARY OF THE INVENTION

The problem of the invention is to form a vane pump with low wear and low noise development, wherein the volume of the pump chambers should be as large as possible. In particular, the vane pump should be suitable for boosting the braking force in a vehicle.

The invention includes the technical teaching that the radius of the inner contour about the rotational axis varies according to the function: $r=r_0+a\cdot\sin(n\cdot\phi)$, where $r_0=(r_{max}+r_{min})/2$, $a=(r_{max}-r_{min})/2$, and $\phi$=phase angle of the radius between the minimum radius and the maximum radius in the rotational direction of the rotor.

With the function specified in cylindrical coordinates for forming the inner contour according to the invention, it could be determined that the acceleration behavior of the vane elements is improved in comparison with an elliptical inner contour of the cam ring, wherein lower wear and lower noise development could be defined. If the inner contour is constructed in accordance with the function according to the invention, then an inner contour is produced for forming the lift sections with a radius that is greater than a radius that is constructed by an inner contour of the cam ring according to an equation of an ellipse about the rotational axis. The larger radius produces an improved behavior of the contact line between the outer edge of the vane elements in contact against the inner contour of the cam ring, because the contact line is variable over the crest of the outer edge in comparison to an elliptical shape, which minimizes the wear. Flattening the acceleration peaks of the vane elements also produces an improvement in the running of the vane pump.

Through the function according to the invention for forming the inner contour, this can be defined by a radius about the rotational axis and this radius varies in its magnitude with a trigonometric function with respect to the mean radius. The number n of lift sections can be constructed with n=2, n=3, or n>3, where n is selected from the set of natural numbers. If n is defined, for example, with 1, this produces the function $r=r_0\cdot a\cdot\sin(\phi)$.

The function of the radius according to the invention for forming the inner contour of the cam ring is specified in cylindrical coordinates and obviously the present invention also extends to a function for describing the inner contour that is specified, analogous to the cylindrical coordinates, in Cartesian coordinates.

The radius of the inner contour about the rotational axis coincides over an angle of $\phi=360°$ for n=two sections, four times with the radius of the elliptical inner contour of the cam ring. An elliptical contour can here be described with the function $r=(r_{min}\cdot r_{max})/[(r_{min}^2\cdot(\sin(\phi))^2+r_{max}^2\cdot(\cos(\phi))^2]^{1/2}$, where $r_{min}$ describes the main axis and $r_{max}$ describes the minor axis of the ellipse.

The vane pump is preferably formed for use in a brake booster for motor vehicles and the rotor can rotate, for example, at a rotational speed from 1000 rpm to 10,000 rpm, preferably from 3000 rpm to 8000 rpm, and especially preferred 6000 rpm. The vane pump can preferably include an electric motor that drives the rotor.

BRIEF DESCRIPTION OF THE DRAWINGS

Reference is now made more particularly to the drawings, which illustrate the best presently known mode of carrying out the invention and wherein similar reference charac-ters indicate the same parts throughout the views.

DETAILED DESCRIPTION OF THE DRAWINGS

Figure 1:
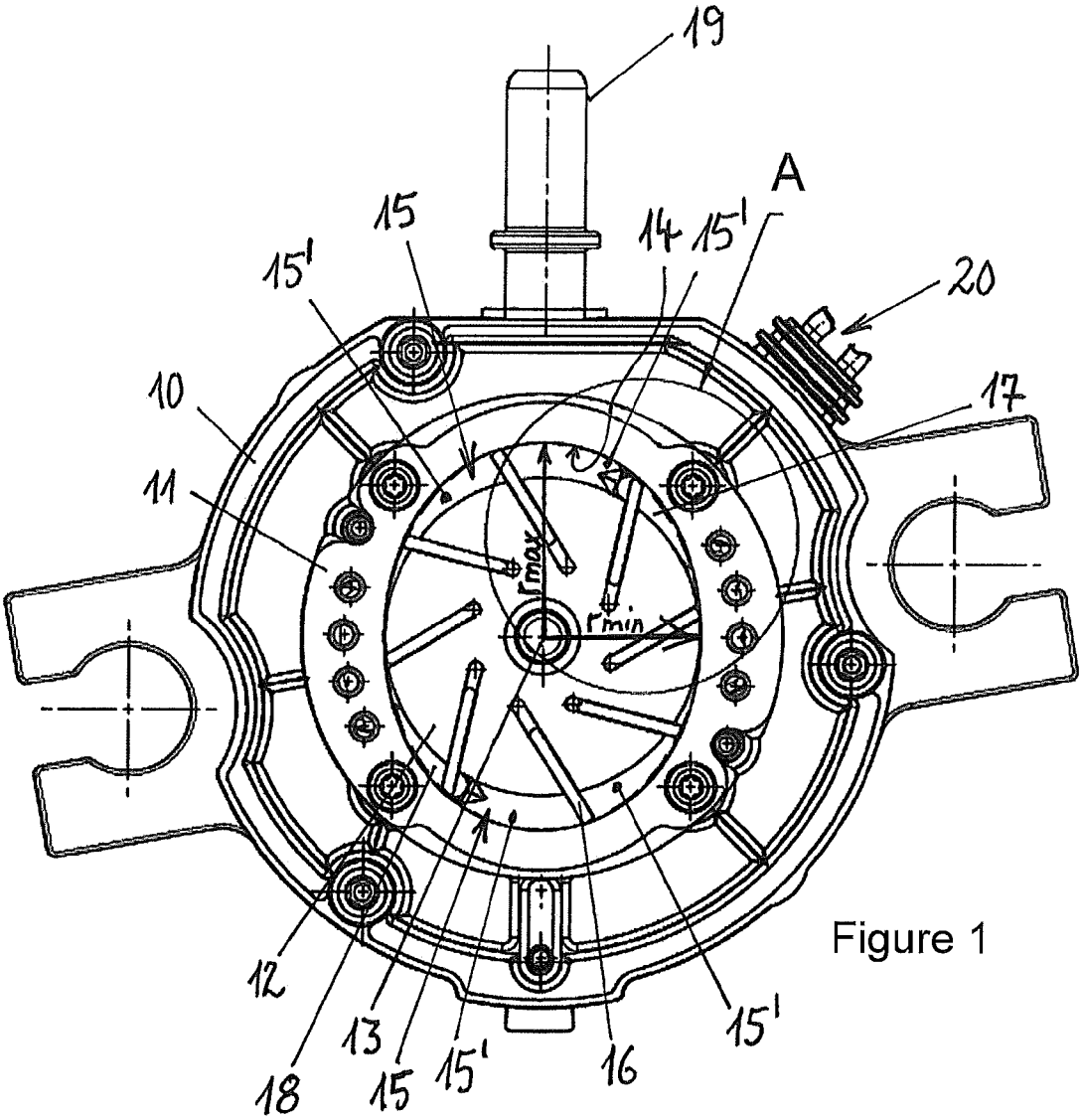
FIG. 1 is a cross-sectional view through a vane pump with a pump housing and with a cam ring in which a rotor rotates and on which vane elements are mounted.

FIG. 1 shows a cross-sectional view of a vane pump 1 with a pump housing 10. A cam ring 11 that is equipped with an inner contour 14 is mounted in the pump housing 10. A rotor 12 is mounted so that it can rotate about a rotational axis 13 within the cam ring 11. On the rotor 12 there are vane elements 16 that slide, with their outer sides, against the inner contour 14 when the rotor 12 is set into rotation about the rotational axis 13. The inner contour 14 is constructed such that two lift sections 15 are constructed with pump chambers 15' in these sections, wherein the lift sections 15 are diametrically opposite each other and the pump chambers 15' form so-called vane cells. The pump chambers 15' are limited by the vane elements 16, so that several pump chambers 15' are formed from the volume of one lift section 15. In the first lift section 15, a suction opening 17 opens and in the opposing second lift section 15, a pressure opening 18 opens, wherein the suction opening 17 is in fluid connection with a suction connection 19. For driving the rotor 12, an electric motor is used that is arranged in a way that is not shown in more detail in or on the pump housing 10 and can be operated by means of an electrical connection 20 with electrical energy.

The inner contour 14 varies between a minimum radius $r_{min}$ and a maximum radius $r_{max}$, wherein, as an example, $r_{max}$ is reached at a 12-o'clock position, and wherein $r_{min}$ is reached at a 3-o'-clock position, so that the angle between the maximum radius $r_{max}$ and the minimum radius $r_{min}$ is 90° ($0<\phi<<\pi/2$).

Figure 2:
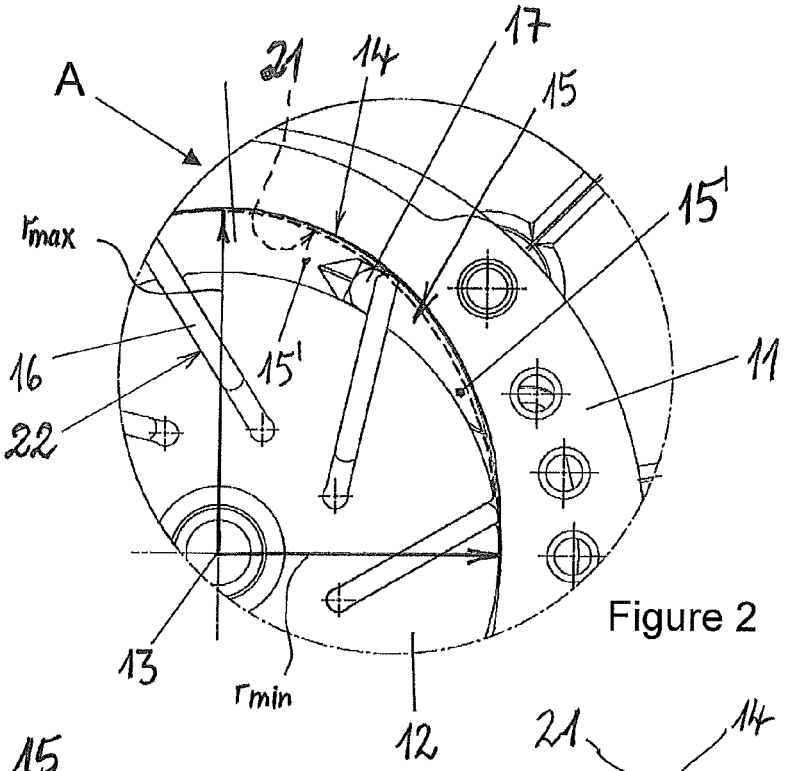
FIG. 2 is a section A, as shown in FIG. 1.

FIG. 2 shows the section A, as shown in FIG. 1, and the inner contour 14 of the cam ring 11 is shown over a segment of approximately 90°. The radius r is shown here with a minimum radius $r_{min}$ at 0° and a maximum radius $r_{max}$ at 90°. Shown is an inner contour 14 that is defined with the function $r=r_0+a\cdot\sin(n\cdot\phi)$ according to the present invention; furthermore, an inner contour 21 according to an equation of an ellipse is shown for comparison. Here it can be seen that the radius of the inner contour 14 is greater with respect to the rotor axis 13 than an inner contour 21 that is constructed according to an equation of an ellipse. If the rotor 12 rotates about the rotational axis 13, then the outer edges of the vane elements 16 slide on the inner contour 14. Due to the farther projecting inner contour 14 that also generates an increase of the lift sections 15 with the pump chambers 15' with respect to the inner contour 21 according to an equation of an ellipse, the vane elements 16 move, beginning at $r_{min}$ and with a rotation of the rotor 12 in the counterclockwise direction, out from their receptacle pockets 22 from the rotor 12, so that for the lifting movement of the vane elements 16, a harmonic movement is produced and the contact line between the outer sides of the vane elements 16 and the inner contour 14 wanders periodically back and forth over the crest of the vane elements 16 on the outer side, which produces reduced wear.

The inner contour 14 is more projecting than the inner contour 21, with respect to the rotational axis 13, according to an equation of an ellipse, and the vane elements 16 are pressed radially inward by a movement of the vane elements 16 in the position $r_{min}$ up to the position $r_{max}$ against the centrifugal force that presses the vane elements 16 against the inner contour 14, wherein reduced wear is also realized in the further angular profile.

Figure 3:
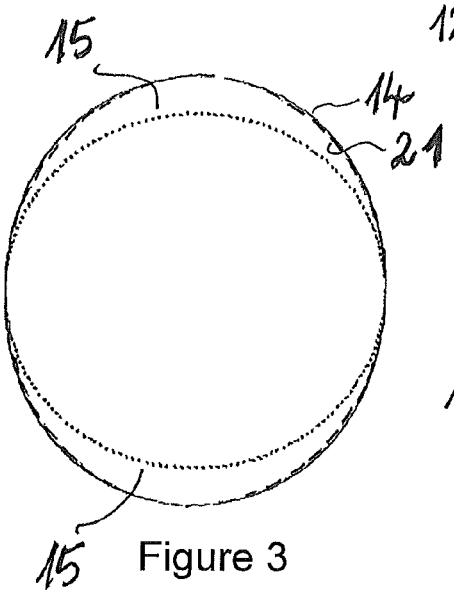
FIG. 3 is a profile of an inner contour according to the present invention in comparison with the profile of an inner contour, when this is constructed like an ellipse, wherein, with n=2, two lift sections are formed.
Figure 4:
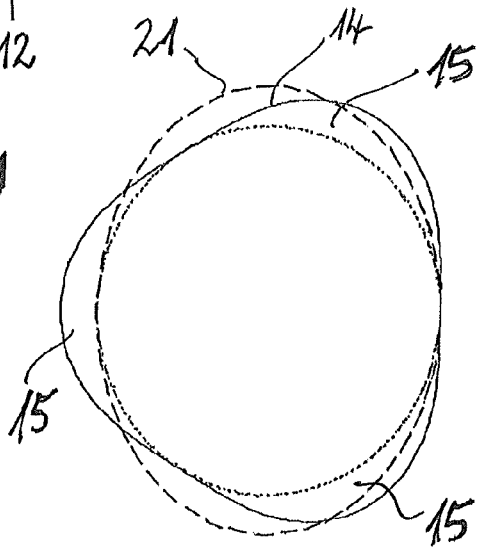
FIG. 4 is a profile of an inner contour according to the present invention in comparison with the profile of an inner contour, when this is constructed like an ellipse, wherein, with n=3, three lift sections are formed.

FIG. 3 shows an inner contour 14 for a number of lift sections 15 in comparison with an inner contour 21 according to an equation of an ellipse with n=2; FIG. 4 shows an inner contour 14 also in comparison with an inner contour 21 according to an equation of an ellipse with a number of lift sections 15 with n=3.

The invention is not limited in its design to the preferred embodiment specified above. On the contrary, a number of variants are conceivable that use the solution shown above, even for designs that are fundamentally different. All of the features and/or advantages emerging from the claims, the description, or the drawings, including structural details or spatial arrangements, can be considered essential to the invention both in themselves and also in different combinations.

LIST OF REFERENCE SYMBOLS

1 Vane pump
10 Pump housing
11 Cam ring
12 Rotor
13 Rotational axis
14 Inner contour
15 Lift section
15' Pump chamber
16 Vane element
17 Suction opening
18 Pressure opening
19 Suction connection
20 Electrical connection

21 Inner contour according to an equation of an ellipse
22 Receptacle pocket
n Number of lift sections
$r_{min}$ Minimum radius
$r_{max}$ Maximum radius

The invention claimed is:

1. A vane pump comprising:

a pump housing including a cam ring;

a rotor mounted in the cam ring so that it can rotate about a rotational axis;

the cam ring including an inner contour with a variable radius that varies between a maximum radius (rmax) and a minimum radius (rmin) in a circumferential direction about the rotational axis;

a radial gap formed between the inner contour and the rotor;

a number (n) of lift sections each formed from a gap between the cam ring and the rotor, the lift sections constructed with pump chambers in the lift sections; and a plurality of vane elements are mounted on the rotor that slide against the inner contour of the cam ring and limit the pump chambers in the peripheral direction, wherein the variable radius (r) of the inner contour varies about the rotational axis according to the function:

$$r=r0+a\cdot\sin(n\cdot\phi),$$

where r0=(rmax+rmin)/2, a=(rmax−rmin)/2 and

ϕ=phase angle of the variable radius between (rmin) and (rmax) in the direction of rotation of the rotor.

2. The vane pump according to claim 1, wherein the inner contour for each lift section has a greater radius than a radius that is formed by an inner contour of the cam ring according to an equation of an ellipse about the rotational axis.

3. The vane pump according to claim 1 wherein the inner contour is defined by the variable radius about the rotational axis and this variable radius varies in its magnitude with respect to a mean radius.

4. The vane pump according to claim 3 wherein the variable radius of the inner contour about the rotational axis over an angle ϕ of 360° for a number (n) of lift sections with n=2 coincides four times with the radius of an elliptical inner contour of the cam ring.

5. The vane pump according to claim 1 wherein the vane pump includes at least two lift sections.

6. The vane pump according to claim 1 wherein the rotor rotates at a rotational speed from 1000 rpm to 10,000 rpm.

7. The vane pump according to claim 1 for use in a brake booster for motor vehicles.

* * * * *